US010524535B2

(12) United States Patent
Vainer

(10) Patent No.: US 10,524,535 B2
(45) Date of Patent: Jan. 7, 2020

(54) SHOE INSOLE REPLACEMENT METHOD

(71) Applicant: Igor Vainer, Manalapan, NJ (US)

(72) Inventor: Igor Vainer, Manalapan, NJ (US)

( * ) Notice: Subject to any disclaimer, the term of this patent is extended or adjusted under 35 U.S.C. 154(b) by 0 days.

(21) Appl. No.: 16/137,089

(22) Filed: Sep. 20, 2018

(65) Prior Publication Data

US 2019/0021440 A1 Jan. 24, 2019

(51) Int. Cl.
*A43B 7/28* (2006.01)
*A43B 17/00* (2006.01)
*A43B 7/22* (2006.01)

(52) U.S. Cl.
CPC ..... *A43B 7/28* (2013.01); *A43B 7/22* (2013.01); *A43B 17/003* (2013.01)

(58) Field of Classification Search
CPC ..... A43B 7/22; A43B 7/223; A43B 7/28
See application file for complete search history.

(56) References Cited

U.S. PATENT DOCUMENTS 2,487,691 A * 11/1949 Boos ..... A43B 7/142 36/165
3,325,922 A * 6/1967 Bray ..... A43B 23/087 36/77 R
3,995,002 A * 11/1976 Brown ..... A43B 7/28 264/571
4,563,787 A * 1/1986 Drew ..... A43D 999/00 12/142 N
4,669,142 A 6/1987 Meyer
4,694,589 A * 9/1987 Sullivan ..... B29D 35/122 12/146 BR
4,868,945 A 9/1989 DeBettignies
4,888,841 A 12/1989 Cumberland
4,910,886 A * 3/1990 Sullivan ..... A43B 7/28 36/43
5,687,467 A 11/1997 Bergmann et al.
5,746,952 A * 5/1998 Marshall ..... A43B 7/28 12/146 L
9,549,587 B1 * 1/2017 Mackay ..... A43B 7/28
2001/0001351 A1 * 5/2001 Dieckhaus ..... A43B 7/141 36/44

(Continued)

OTHER PUBLICATIONS

Stephanie, DIY Replacement Insoles, http://totallystitchin.net/articles/diy-replacement-insoles, Jan. 29, 2016 (Year: 2016).*

(Continued)

*Primary Examiner* — Shaun R Hurley
*Assistant Examiner* — Bao-Thieu L Nguyen

(57) ABSTRACT

An insole of an embodiment of the disclosed technology is formed by way of taking an insole of an existing shoe (or footwear), tracing the existing insole on to a flat sheet of material, and cutting out a new insole in the same shape (side edge dimensions) as the original or substantially there-so. The material is resilient but can be made malleable at a higher temperature using such materials known in the art. It is raised to a higher temperature, then placed into the existing shoe on top of or in place of the existing insole. A person then wears the shoe with the new (hot) insole causing the insole to compress. Upon cooling and while still wearing same, the insole retains a new compressed shape formed to bottom contours of the foot of the wearer.

11 Claims, 8 Drawing Sheets

(56) References Cited

U.S. PATENT DOCUMENTS

2004/0194348 A1* 10/2004 Campbell ..... A43B 7/142 36/93
2005/0120591 A1* 6/2005 Andrew ..... A43B 3/26 36/29
2008/0010856 A1* 1/2008 Hakkala ..... A43B 7/28 36/43
2008/0098617 A1* 5/2008 Garrett ..... A43B 1/0045 36/11.5
2009/0044426 A1 2/2009 Levine
2011/0094046 A1* 4/2011 Favreau ..... A43B 7/28 12/146 B
2011/0099853 A1* 5/2011 DelCielo ..... A43B 13/08 36/25 R
2012/0090198 A1* 4/2012 Stratten ..... A43B 1/0045 36/44
2012/0131817 A1* 5/2012 Kaakkola ..... A43B 7/142 36/44
2012/0216428 A1* 8/2012 Marandos ..... A43B 3/0078 36/130
2015/0001199 A1 1/2015 Jeon
2016/0000184 A1* 1/2016 Guadalajara ..... B29C 44/5618 36/44
2016/0183629 A1 6/2016 Hsieh
2016/0213094 A1 7/2016 Matsui
2016/0286897 A1* 10/2016 Louko ..... A43B 17/006
2016/0374431 A1* 12/2016 Tow ..... A43B 17/003 36/43
2017/0202300 A1* 7/2017 Sherman ..... A43B 17/006
2017/0231320 A1* 8/2017 Nunez ..... A43B 1/0045 36/93

OTHER PUBLICATIONS

Evo, "How to Trim Ski & Snowboard Boot Footbeds", Nov. 27, 2013, https://www.youtube.com/watch?v=dRRc6P0Qm_Y (Year: 2013).*

* cited by examiner

SHOE INSOLE REPLACEMENT METHOD

FIELD OF THE DISCLOSED TECHNOLOGY

The disclosed technology relates generally to insoles for shoes, and more specifically to sizing insole edges and top sides to match that of a shoe and wearer.

BACKGROUND OF THE DISCLOSED TECHNOLOGY

People with foot problems and pain are well familiar with the problem of new shoes which hurt or old shoes with worn away insoles that hurt. Some go to podiatrists to get new shoe insoles molded to the size of their feet by way of laser guided measurements or casts of the bottom of the foot. Another typical option is to by an off the shelf shoe insert and place this insert into the shoe but it is typically of a different feel and size than the original and less comfortable.

What is needed is a simpler and inexpensive way of replacing a shoe insert, but one which has the precision of a shoe insert made for a particular shoe as well as the foot of the wearer without the significant expense of a specialist-made insert. Further, even specialist (podiatrist) made inserts typically match the foot of the wearer but fail to match the exact shape of the shoe. This problem in the art also leaves room for improvement in a way which does not add significant expense.

SUMMARY OF THE DISCLOSED TECHNOLOGY

An insole of a shoe is replaced with another insole in the following manner, in embodiments of the disclosed technology. A a flat, planar, resilient, pliable, and cutable sheet of material is provided or used. In some embodiments, this material is part of a kit with instructions for use. The sheet of material is one which is non-malleable when at room temperature or ambient temperature, and which becomes malleable through a combination of being elevated to a higher temperature and kept in a changed shape until cooling back to ambient/room temperature.

For purposes of this disclosure, the following definitions are used. "Flat" is defined as "without marked lumps or indentations greater than 8 millimeters, 5 millimeters, or 2 millimeters" depending on embodiment. "Planar" is defined as "substantially within a same two dimensional plane." "Resilient" is defined as "able to return to a same shape substantially a same shape after forces applied there-to substantially changed the shape thereof." "Pliable" is defined as "bendable by an adult human using his or her hands and without the aid of tools." "Cutable" is defined as "able to be sliced there-through with manual knife or pair of scissors held in one hand." "Malleable" is defined as "able to be pressed permanently out of a original shape and into another shape without breaking or cracking." "Permanently" is defined as "retaining a shape or designed to retain a shape through at least 100 intended uses of a device which is described by the the adjective of 'permanently' and/or retain the shape until heated enough to cause melting thereof combined with forces causing bending thereof."

The insole to be replaced is placed, in embodiments of the disclosed technology, on the above-described sheet of material. Then, the process of forming a new insole is carried out by cutting a likeness of the insole into the sheet of material. A "likeness" is defined as one which has a substantially same sized most elongated or most planar side and/or having an edge with substantially a same shape. An "edge" is a narrow side between what would be recognizable to an ordinary observer as an elongated and flat or substantially flat/planar side. Thus, in embodiments of the disclosed technology, a substantially flat and planar elongated side is bound by the "edge".

One then heats, using a heat source, the new insole until the new insole becomes less resilient and more pliable and/or malleable. Then after removing the new insole from a heat source, such as a microwave or standalone electric heater, one places the new insole an article of footwear. This article of footwear can be one in which the previous insole which was used for the tracing/cutting of the new insole was previously placed therein and/or inserted. One then wears the article of footwear while the new insole is still in an elevated temperature condition (and therefore, still able to be changed in shape permanently). This wearing includes applying weight to the flat and planar elongated side of the new insole. Once the insole cools, the elongated previously flat side should, in embodiments of the disclosed technology, permanently change in shape to correspond to a bottom of a foot of the wearer thereof.

Once the new insole cools to room temperature, the shape corresponding to the contours of the foot becomes permanent. In order for the insole to change in shape, the heating required can be at least 200 degrees, in some embodiments, 275 degrees Fahrenheit and it has been found that this temperature needs to be maintained around/at the insole for a period of about 2 minutes (100, 120, or 140 seconds) for the insole to become malleable enough to change it's shape and then hold the shape upon returning to ambient/room temperature. The step of placing the new insole into the article of footwear is carried out while the new insole is at least 50 degrees Fahrenheit above ambient temperature and/or is malleable and/or is non-resilient in some embodiments of the disclosed technology.

Described another way, one provides instructions to carry out the method of placing a new insole in a shoe by providing resilient, pliable, and cutable material have an elongated planar side having a surface area larger than a pre-existing insole of a shoe. A wearer of the shoe is then instructed to cut the elongated planar side into a shape of the pre-existing insole of the shoe forming a new insole. The wearer is further instructed to heat the new insole to at least 200 degrees Fahrenheit, remove the new insole from the heat after it has become more easily pliable (compared to at room temperature), and place the new insole in the shoe while the new insole is still at an elevated temperature. Finally, the wearer is instructed to wear the shoe with the new insole which causes the new insole to mold to a contour/shape of a bottom side of the wearer's foot.

Additionally, the wearer can be instructed to trace (the shape of) the new insole out of/on to the elongated planar side of the material. The instructions can also include instructions to place the new insole into the shoe while the new insole is between room temperature and a temperature of the heat source. This can ensure that a step of compressing the new insole into the shoe to conform to the wearer's foot is carried out while the new insole is still more easily pliable than at room temperature.

"Substantially" and "substantially shown," for purposes of this specification, are defined as "at least 90%," or as otherwise indicated. "Identical" or "exactly," for purposes of this specification, is defined as "within an acceptable tolerance level known in the art." Any device may "comprise," or "consist of," the devices mentioned there-in, as limited by the claims. Any element described may be one of "exactly" or "substantially," as described.

It should be understood that the use of "and/or" is defined inclusively, such that the term "a and/or b" should be read to include the sets: "a and b," "a or b," "a," or "b."

BRIEF DESCRIPTION OF THE DRAWINGS

FIG. 3 shows outlines of the existing insoles traced onto the sheet of

FIG. 2 in an embodiment of the disclosed technology.

DETAILED DESCRIPTION OF EMBODIMENTS OF THE DISCLOSED TECHNOLOGY

An insole of an embodiment of the disclosed technology is formed by way of taking an insole of an existing shoe (or footwear), tracing the existing insole on to a flat sheet of material, and cutting out a new insole in the same shape (side edge dimensions) as the original or substantially there-so. The material is resilient but can be made malleable at a higher temperature using such materials known in the art. It is raised to a higher temperature, then placed into the existing shoe on top of or in place of the existing insole. A person then wears the shoe with the new (hot) insole causing the insole to compress. Upon cooling and while still wearing same, the insole retains a new compressed shape formed to bottom contours of the foot of the wearer.

Embodiments of the disclosed technology will become clearer in view of the following description of the drawings.

Figure 1:
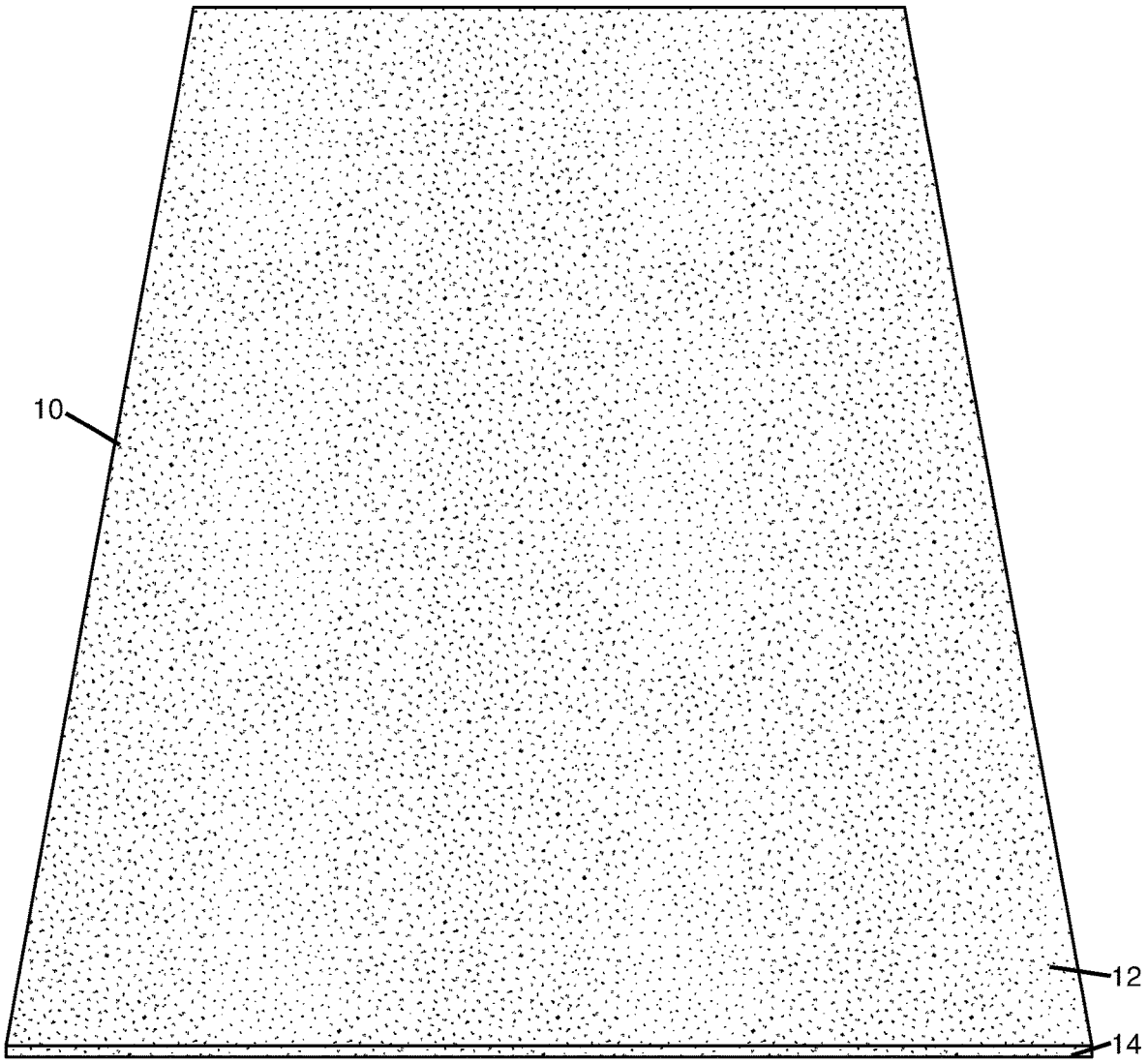
FIG. 1 shows a sheet of flat, planar, resilient, and pliable material which is cutable into a shape of an insole as used in embodiments of the disclosed technology.

FIG. 1 shows a sheet of flat, planar, resilient, and pliable material which is cutable into a shape of an insole as used in embodiments of the disclosed technology. Definitions of the terminology are provided in the "summary" section. Here, this planar, flat sheet 10 has a generally flat and elongated top side 12 which is the largest or substantially the largest exterior side of the sheet of material. An edge 14 extends around the perimeter of the elongated flat side 10. The material is compressible and resilient meaning that once compressed (decreased in size in any direction, such as compressing the height of the edge 14 between the two elongated flat sides 12 and the opposite side of the side 12), the original shape is substantially restored. However, since the material is made from certain polymers and/or plastics known in the art in some embodiments, when heated above a certain temperature, the fibers begin to melt and the sheet 10 becomes changeable in shape and/or loses it's resilience while in the elevated temperature when/if it is compressed (such as compressed at least 10% in any direction).

Figure 2:
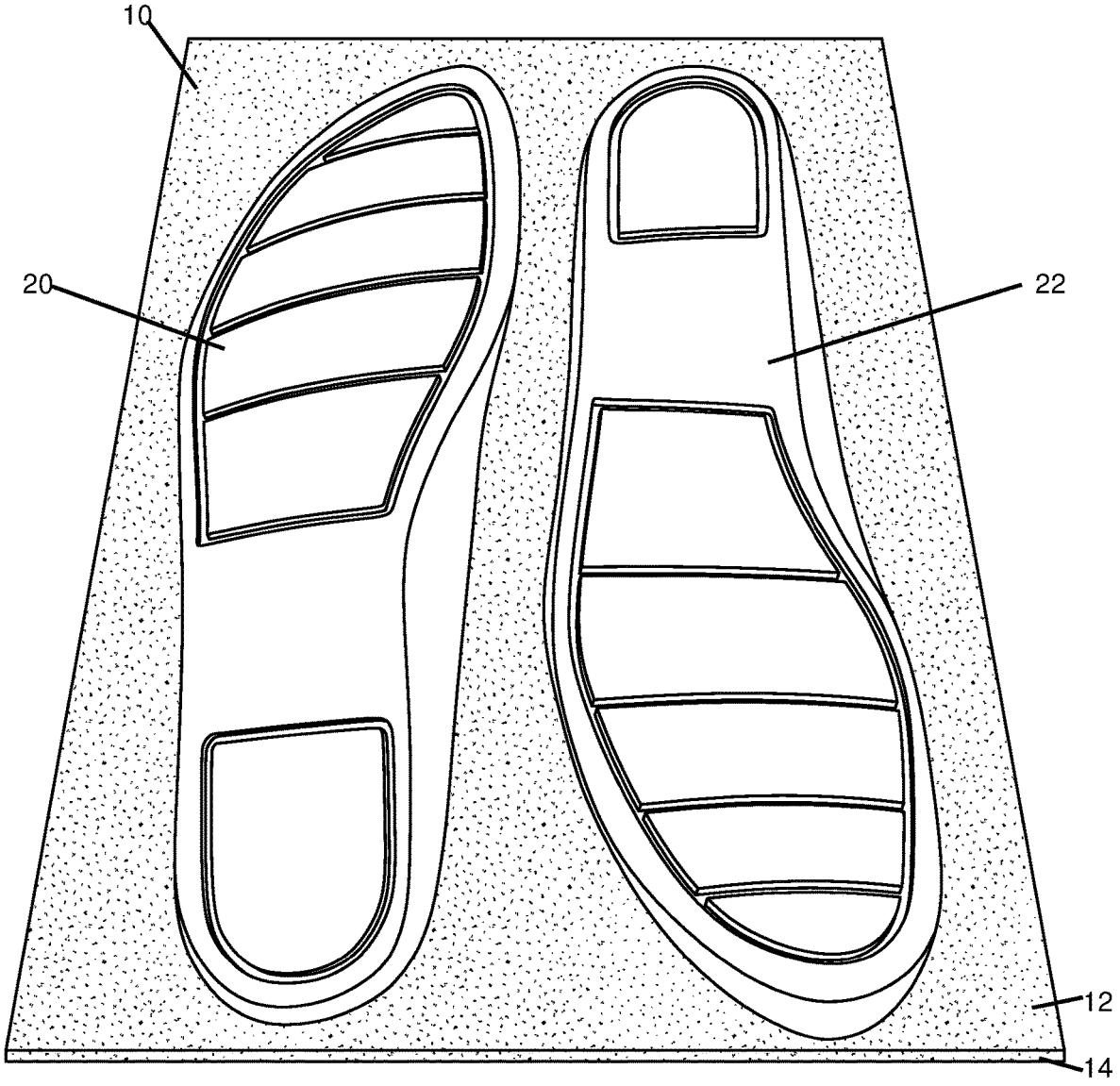
FIG. 2 shows existing insoles placed on the sheet of FIG. 1 in an embodiment of the disclosed technology.

FIG. 2 shows existing insoles placed on the sheet of FIG. 1 in an embodiment of the disclosed technology. Here, insoles 20 and 22 have been removed from an existing shoe and are sized to fit the existing shoe where, since they come from an existing shoe, are already sized to fit properly in said shoe. In the method of the invention, one is instructed to, and/or does outline the shoes on the sheet 10. In this manner, one creates on the sheet 10 a drawing with the measurements of a new insole placed there-upon which matches that of the existing insoles 20 and 22, which, in turn, matches that of what will fit properly in an existing shoe or other article of footwear.

Figure 3:
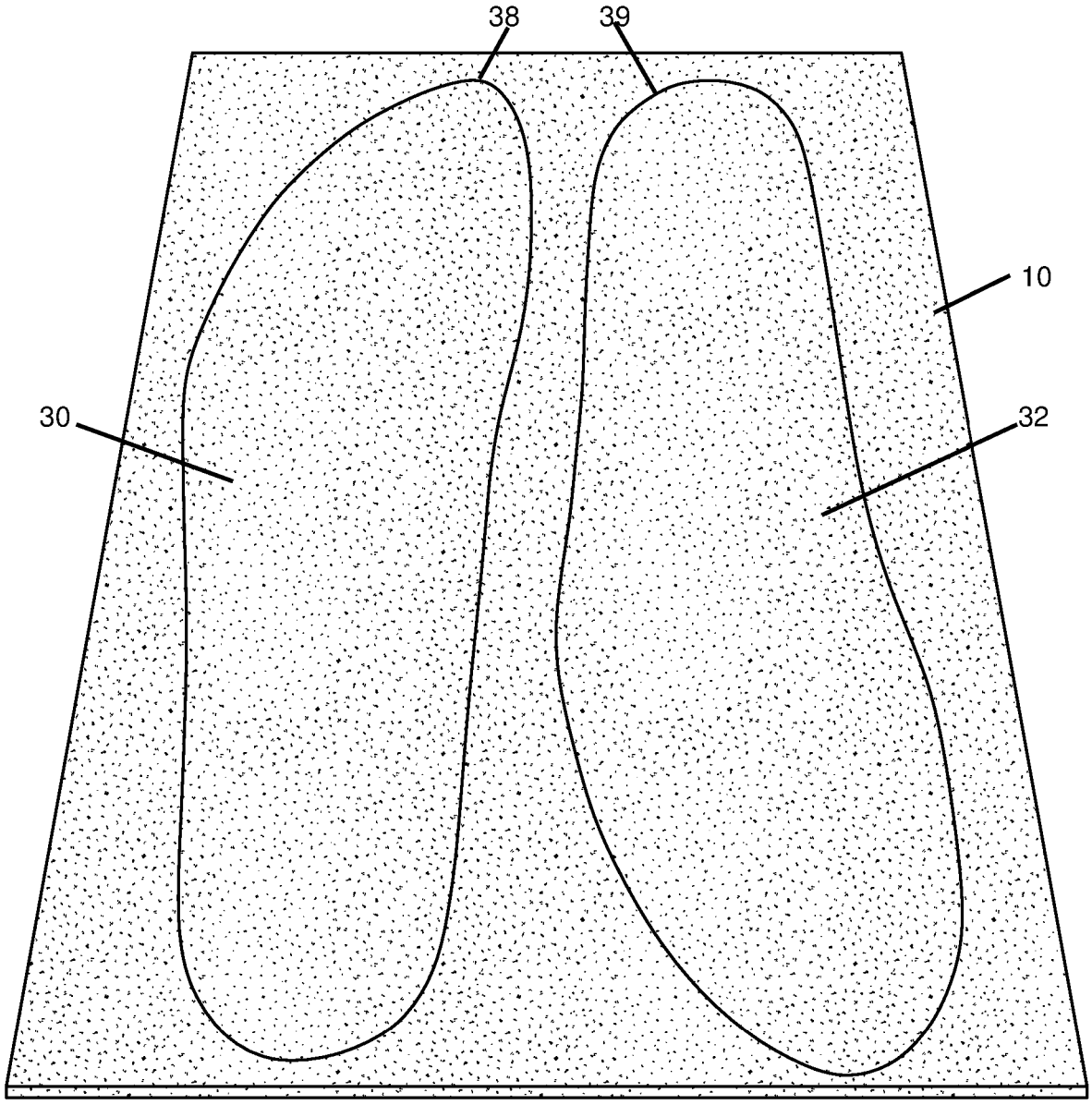

FIG. 3 shows outlines of the existing insoles traced onto the sheet of FIG. 2 in an embodiment of the disclosed technology. As described with reference to FIG. 2, in FIG. 3 the outlines 38 and 39 of the existing or first insoles are shown on the sheet of material 10. These outlines can then be cut out from the sheet 10 to create a precursor version of a new insert, or as shown, two precursors of inserts 30 and 32. The cuts to the new insoles are made around the entire circumference of each one and through to and including the bottom side of the sheet in embodiments of the disclosed technology.

Figure 4:
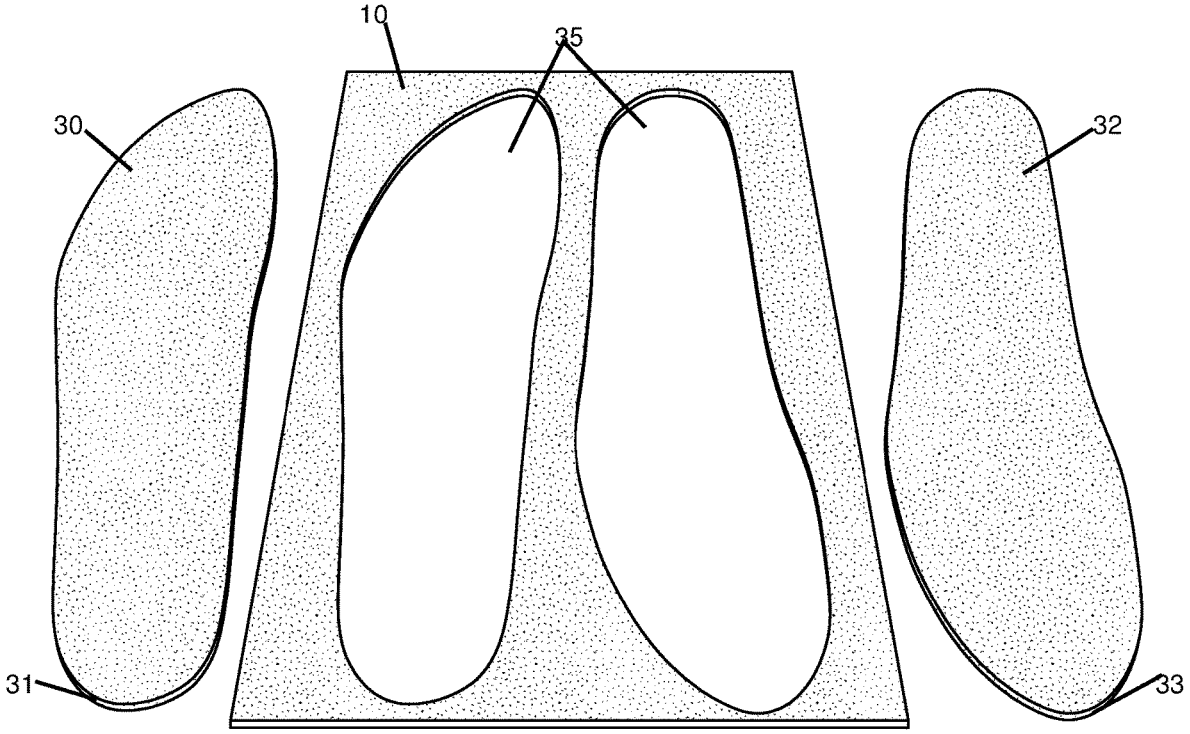
FIG. 4 shows new inserts formed from the cutouts of the material of FIG. 3 in an embodiment of the disclosed technology.

FIG. 4 shows new inserts formed from the cutouts of the material of FIG. 3 in an embodiment of the disclosed technology. Here, the precursor new insoles 30 and 32 are removed, each having respective edges 31 and 33 which, in embodiments of the disclosed technology, have the same depth as that of the edge 14 of the original sheet. The precursor new insoles 30 and 32 can be used as insoles in the existing shoe, or in embodiments, are heated (or a wearer is instructed to heat). In this manner, the new insoles 30 and/or 32 become more pliable and less resilient and/or lose their resilience. The fibers or other material within melts and can be reshaped when heated above a certain temperature such as 200, 225, 250, 275, or 300 degrees Fahrenheit. It has been found that given the size of the insoles and heat capacity thereof, that in some embodiments of the disclosed technology, exposing the insoles 30 and/or 32 to a temperature of 275 degrees for about 2 minutes (100, 120, or 140 seconds or there-between, inclusive) allowed sufficient heating of the insoles in order to make them pliable enough to be reshaped while using a least amount of time and being easy enough to handle. The heat source can be an electric heat source, microwave oven, gas oven, or the like.

Figure 5:
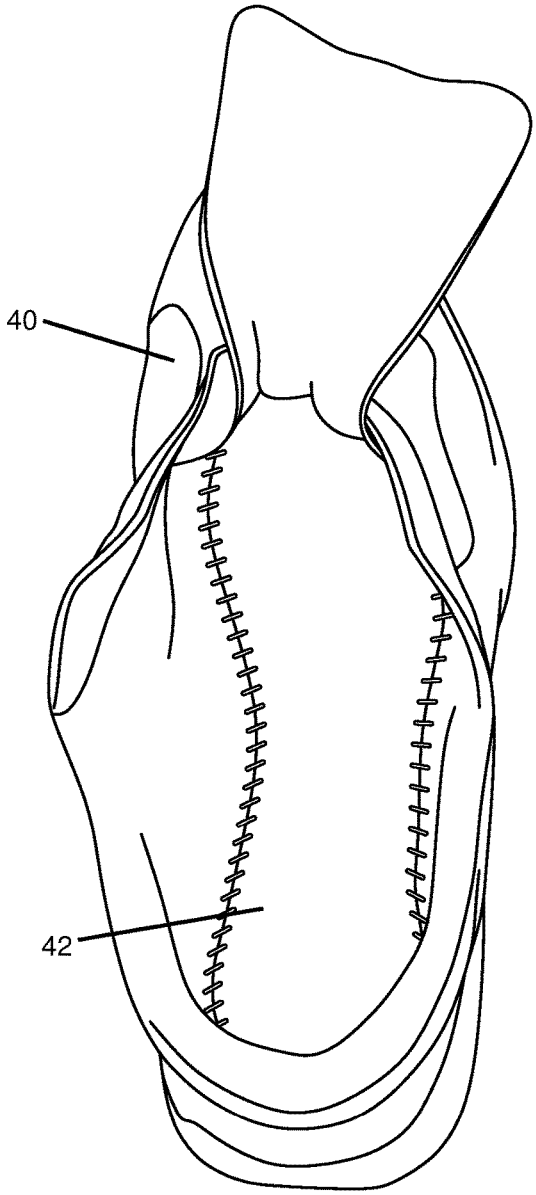
FIG. 5 shows an example of a shoe without an insert in an embodiment of the disclosed technology.
Figure 6:
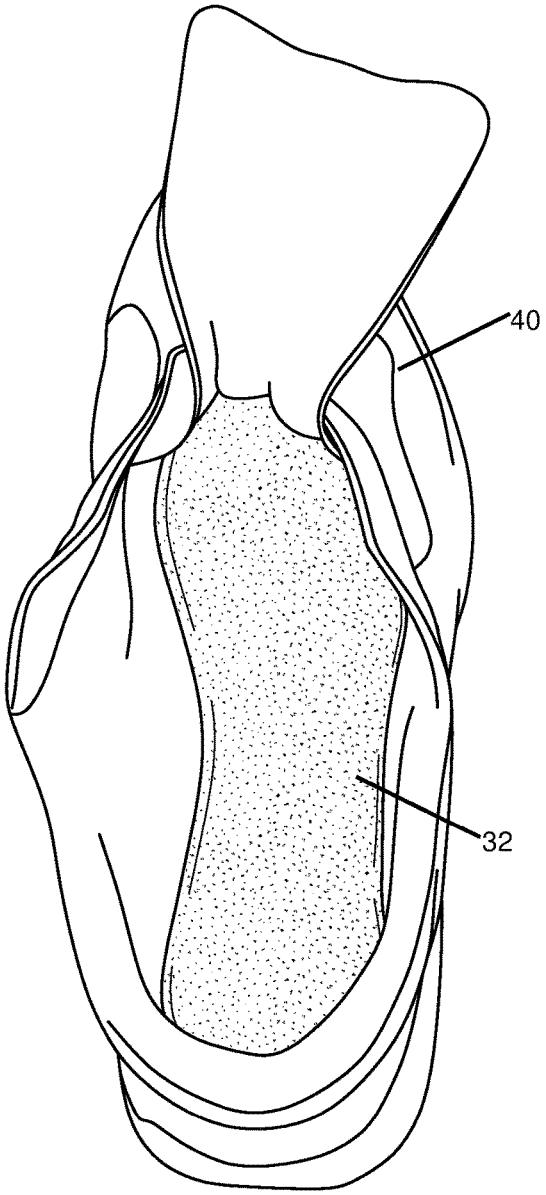
FIG. 6 shows the shoe of FIG. 5 with a heated new insert of FIG. 4 placed therein in an embodiment of the disclosed technology.

FIG. 5 shows an example of a shoe without an insert in an embodiment of the disclosed technology. FIG. 6 shows the shoe of FIG. 5 with a heated new insert of FIG. 4 placed therein in an embodiment of the disclosed technology. Here, once the insert has reached a raised temperature, such as by being exposed to a heat source as described above, it is placed into a shoe 40. In the example shown, the new insole 32 is placed into a right shoe 40 corresponding to the prior existing insert 22. The new insole 32 has the same or substantially the same edge shape as the prior existing insole 22. However, at this time, the top (and bottom) side of the insole is still the same or substantially the same as when it was cut from the material 10, meaning that is substantially flat. Thus, in some embodiments, it is desired to have the new insole 32 fit with the contours of the bottom of a foot of a wearer. This is done, as shown in FIG. 7.

Figure 7:
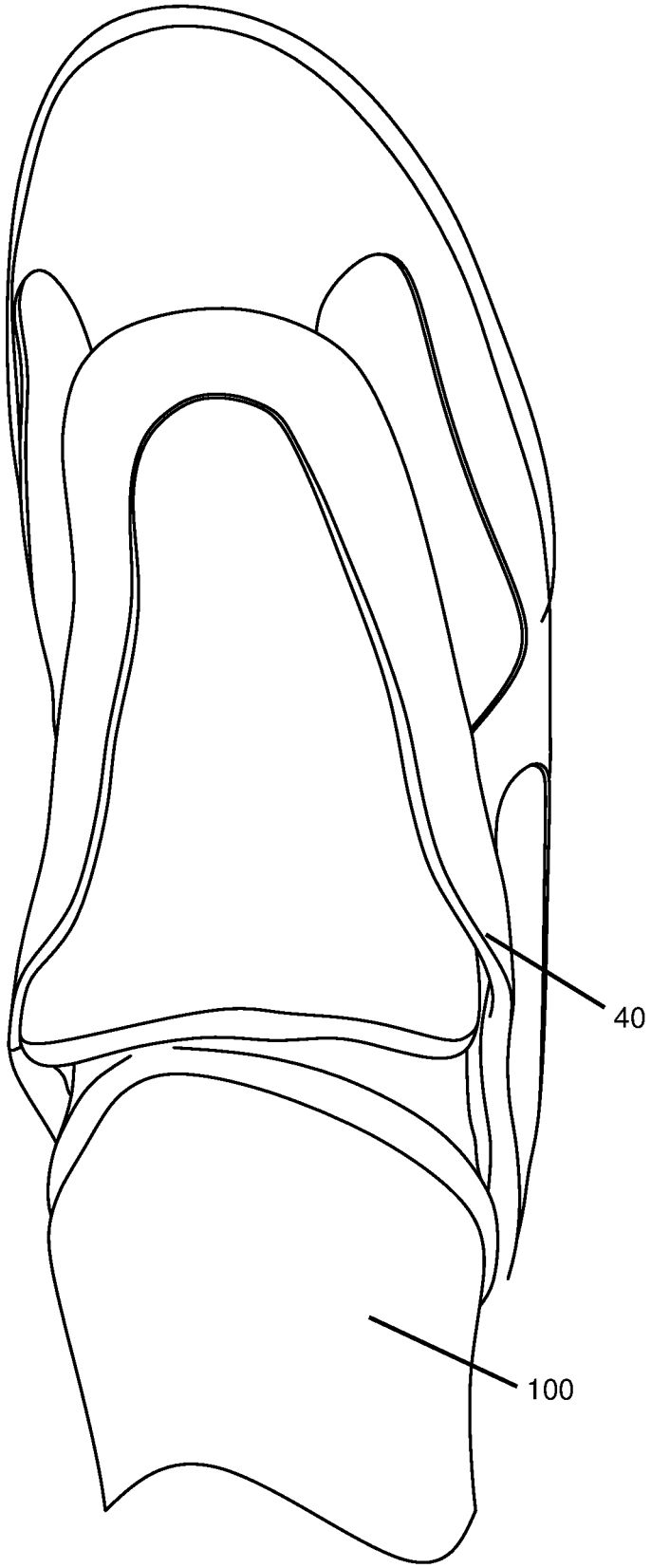
FIG. 7 shows a wearer compressing a new insert into the shoe of FIG. 5 in an embodiment of the disclosed technology.

FIG. 7 shows a wearer compressing a new insert into the shoe of FIG. 5 in an embodiment of the disclosed technology. Here, the wearer inserts his/her foot 100 into the shoe 40 applying downward force/pressure on the on to the top side of the new insole 32. As the new insole 32 is, at this time, still at an elevated temperature (having at least a part thereof which is at least 50 degrees Fahrenheit more than ambient temperature), it is shapable/pliable into a different shape. When held in this different shape until cooled back to or substantially to ambient temperature, the new shape is retained and the insole 32 becomes resilient again, albeit with the new shape defined during the compression at the elevated temperature.

Figure 8:
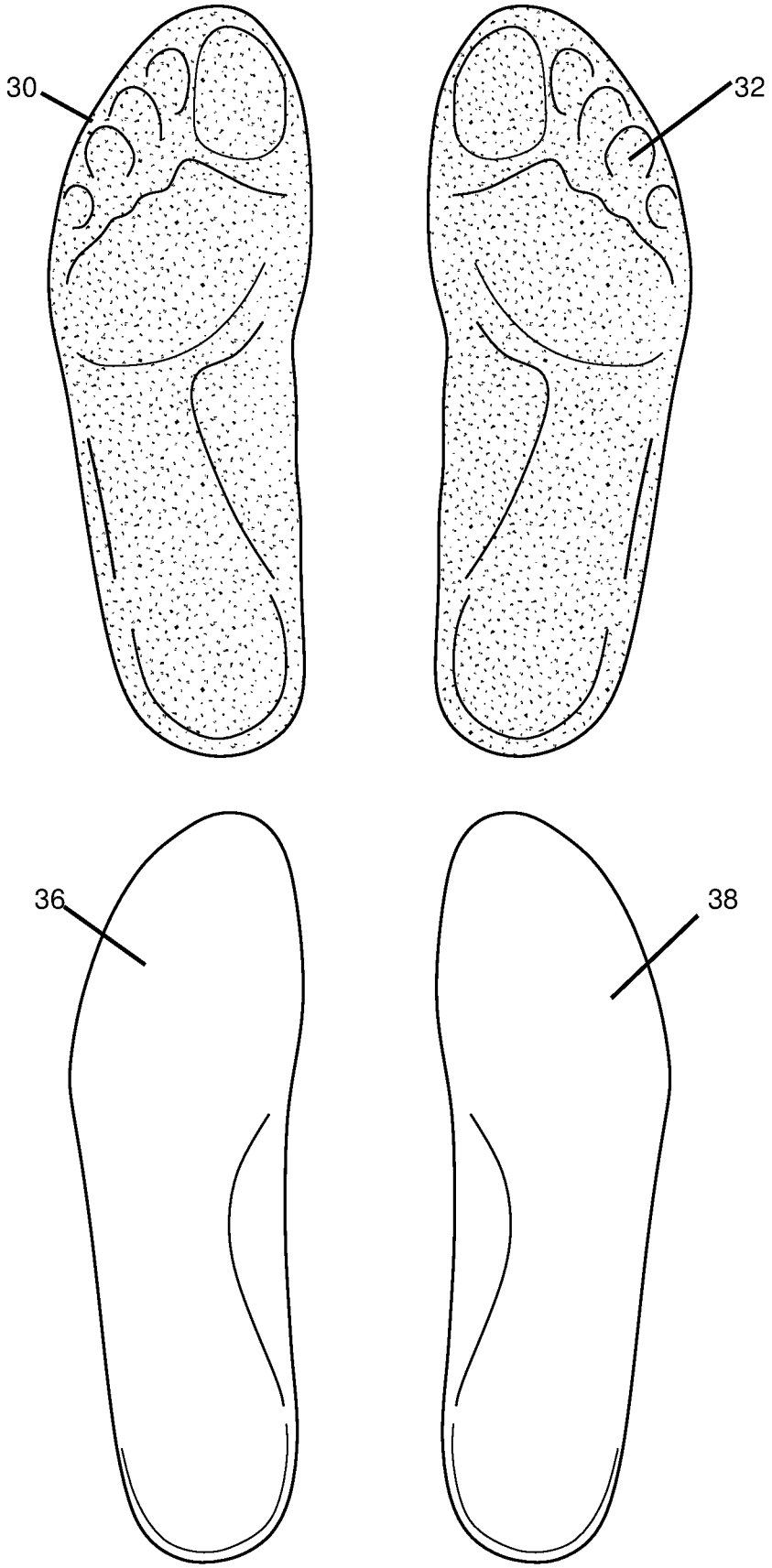
FIG. 8 shows top and bottom sides of a compressed new insert with contours of a person's foot in an embodiment of the disclosed technology.

FIG. 8 shows top and bottom sides of a compressed new insert with contours of a person's foot in an embodiment of the disclosed technology. Here, the top sides are shown at the top of the page with insoles 30 and 32 having depressions corresponding the size and/or pressure and/or mass applied at each location along the top side thereof. The bottom sides 36 and 38 of the respective insoles 30 and 32 are also shown. As such, it can be seen that the insoles 30 and 32 now correspond to the foot of the wearer with contours equal or substantially equal to that of the foot of the wearer in embodiments of the disclosed technology.

Figure 9:
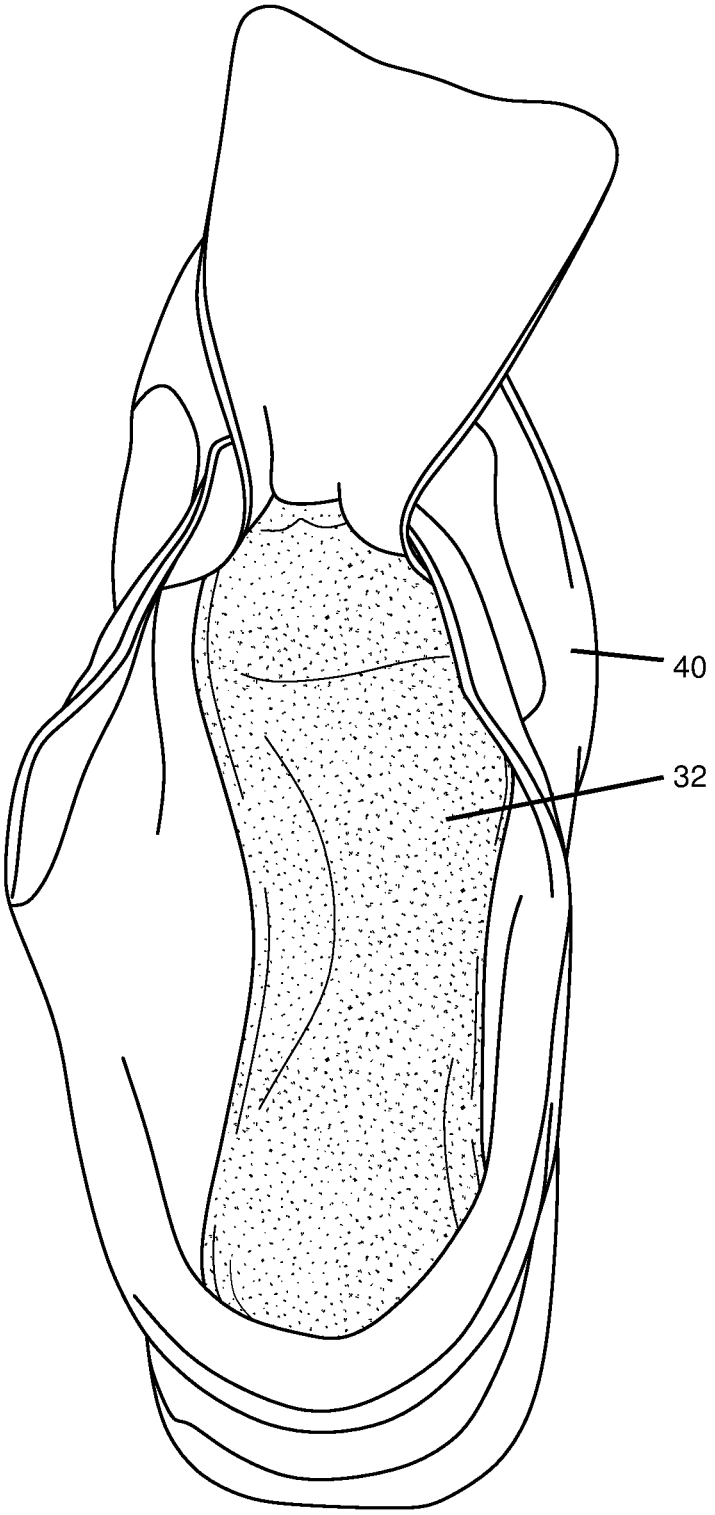
FIG. 9 shows a cooled and compressed new insert with contous of a person's foot inserted into a shoe holding a shape thereof in an embodiment of the disclosed technology.

FIG. 9 shows a cooled and compressed new insert with contours of a person's foot inserted into a shoe holding a shape thereof in an embodiment of the disclosed technology. Here, the insole 32 is placed into the shoe 40 and is ready to be worn.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of placing a new insole in a shoe, by a wearer of the shoe, the method comprising the steps of:

providing a resilient, pliable, and cutable single layer material, which is non-malleable at ambient temperature and malleable at a temperature that is at least 50 degrees Fahrenheit above ambient temperature, said single layer material having an elongated planar side having a surface area larger than a pre-existing insole of a shoe;

instructing said wearer of said shoe to cut said elongated planar side into a same shape of said pre-existing insole of said shoe, thereby forming a new insole;

instructing said wearer to heat said new insole with a heat source to at least 200 degrees Fahrenheit;

instructing said wearer to remove said new insole from said heat source after said new insole reaches a heated temperature of at least 50 degrees Fahrenheit above ambient temperature, such that the single layer material is now malleable and said new insole is more easily pliable than said new insole would be at said ambient temperature;

instructing said wearer to place said new insole into said shoe while the temperature of said new insole is at least 50 degrees Fahrenheit above said ambient temperature;

instructing said wearer to wear said shoe with said new insole while the temperature of said new insole is at least 50 degrees Fahrenheit above said ambient temperature;

instructing said wearer to place a weight of said wearer onto said elongated planar side while the temperature of said new insole is at least 50 degrees Fahrenheit above said ambient temperature; and instructing said wearer to cool said new insole to said ambient temperature while wearing said shoe to permanently change a shape of said elongated planar side such that said shape corresponds to the contours of said wearer 's foot.

2. The method of claim 1, further comprising a step of:

instructing said wearer to trace a shape of said pre-existing insole onto said elongated planar side of said material.

3. The method of claim 1, wherein said wearer is instructed to heat the new insole to 275 degrees Fahrenheit.

4. The method of claim 3, wherein said wearer is instructed to maintain the heat of 275 degrees Fahrenheit for at least 100 seconds.

5. The method of claim 4, wherein said wearer is instructed to maintain the heat of 275 degrees Fahrenheit for 2 minutes.

6. A method of replacing an initial insole by a wearer of said initial insole, comprising the steps of:

providing a substantially flat, resilient, pliable, and cutable single layer material, which is non-malleable at ambient temperature and malleable at a temperature that is at least 50 degrees Fahrenheit above ambient temperature, said single layer material having an elongated planar side having a surface area larger than said initial insole;

placing said initial insole on said single layer material;

forming a new insole by cutting a likeness of said initial insole from said sheet of said single layer material, said likeness having an edge with substantially a same shape of said initial insole while having a substantially flat and planar elongated side bound by said edge;

heating said new insole with a heat source until said new insole reaches a temperature of at least 50 degrees Fahrenheit above said ambient temperature, such that the single layer material is now malleable and said new insole is more easily pliable than said new insole would be at said ambient temperature;

removing said new insole from the heat source when said new insole has reached a temperature of at least 50 degrees Fahrenheit above said ambient temperature;

placing said new insole into an article of footwear where said initial insole was previously inserted while the temperature of said new insole is at least 50 degrees Fahrenheit above said ambient temperature;

wearing said article of footwear while the temperature of said new insole is at least 50 degrees Fahrenheit above said ambient temperature, applying a weight of said wearer onto said elongated planar side of said new insole while the temperature of said new insole is at least 50 degrees Fahrenheit above said ambient temperature; and cooling said new insole to said ambient temperature while wearing said shoe to permanently change a shape of said elongated planar side such that said shape corresponds to the contours of said wearer 's foot.

7. The method of claim 6, wherein said new insole is heated to 200 degrees Fahrenheit.

8. The method of claim 6, wherein said new insole is heated to 275 degrees Fahrenheit.

9. The method of claim 6, wherein said heating is for a period of time not less than 100 seconds.

10. A kit, comprising:

instructions to carry out said steps of claim 6; and a substantially flat, resilient, pliable, and cutable single layer material, which is non-malleable at ambient temperature and malleable at a temperature that is at least 50 degrees Fahrenheit above ambient temperature, said single layer material having an elongated planar side.

11. The method of claim 6, further comprising the step of tracing a shape of said initial insole onto said elongated planar side of said single layer material so as to facilitate the step of cutting a likeness of said initial insole.

* * * * *